US005733052A

United States Patent [19]

Suzuki

[11] Patent Number: 5,733,052

[45] Date of Patent: Mar. 31, 1998

[54] THERMAL PRINTER

[75] Inventor: Minoru Suzuki, Tokyo, Japan

[73] Assignee: Asahi Kogaku Kogyo Kabushiki Kaisha, Tokyo, Japan

[21] Appl. No.: 614,389

[22] Filed: Mar. 12, 1996

[30] Foreign Application Priority Data

Mar. 14, 1995 [JP] Japan ..... 7-081739

[51] Int. Cl.[6] ..... B41J 11/04; B41J 2/32

[52] U.S. Cl. ..... 400/120.01; 400/662; 400/659

[58] Field of Search ..... 400/120.01, 659, 400/660, 662; 100/424.1; 226/615.4, 615.2; 101/422; 347/220

[56] References Cited

U.S. PATENT DOCUMENTS

| | | | |
|---|---|---|---|
| 4,081,169 | 3/1978 | Lauter | 249/115 |
| 4,596,920 | 6/1986 | Inagaki | 219/216 |
| 4,881,838 | 11/1989 | Lohrmann et al. | 400/662 |
| 5,021,804 | 6/1991 | Nozawa et al. | 347/176 |
| 5,198,836 | 3/1993 | Saito et al. | 400/660 |
| 5,553,845 | 9/1996 | Sawa et al. | 271/314 |

FOREIGN PATENT DOCUMENTS

| | | | |
|---|---|---|---|
| 2151185 | 7/1979 | Germany | 101/422 |
| 3736730 | 5/1988 | Germany . | |
| 3802735 | 8/1989 | Germany | 400/622 |
| 1375529 | 11/1974 | Japan . | |
| 60-231763 | 11/1985 | Japan . | |
| 61-284584 | 12/1986 | Japan . | |
| 2169381 | 7/1986 | United Kingdom . | |
| 2194920 | 3/1988 | United Kingdom . | |

OTHER PUBLICATIONS

WPI Abstract Accession No. 86–004376/01 and JP 060231763A (CALP).

*Primary Examiner*—Edgar S. Burr
*Assistant Examiner*—Daniel J. Colilla
*Attorney, Agent, or Firm*—Greenblum & Bernstein P.L.C.

[57] ABSTRACT

A thermal printer has a thermal line printhead, which contacts a recording sheet and creates images on the recording sheet. A platen roller is positioned in a fixed location and bears against the thermal line printhead. When a covering member is closed, the platen roller feeds the recording sheet against the thermal line printhead. The platen roller has a roller unit of rubber composition, the surface of which is coated with an adsorption preventing powder agent to prevent it from adhering to the thermal line printhead.

27 Claims, 4 Drawing Sheets

THERMAL PRINTER

BACKGROUND OF THE INVENTION

The present invention relates to a thermal printer which uses a thermal printhead to form images on recording sheet, and more specifically, to a thermal printer having a platen roller and thermal line printhead.

Conventional thermal printers feed a recording sheet between a thermal printhead and a platen roller. Images are printed on the recording sheet by either moving the thermal printhead and the recording sheet, or by advancing the recording sheet past a stationary thermal line printhead. The thermal line printhead is a linear array of thermal elements extending across the entire width of a printable page, such that the entire width of a page can be printed by moving the recording sheet past the line printhead.

Generally, thermal printers using a thermal line printhead for cut recording sheets have a retraction mechanism for retracting the printhead away from the platen roller. That is, the retraction mechanism of the conventional printer holds the thermal line printhead away from the platen roller when the printer is not in use, but allows the thermal line printhead to contact a recording sheet, against the backing of the platen roller, when printing is performed. In such a design, the thermal line printhead is pressed against the platen roller only when a recording sheet is present in the sheet feeding path.

The retraction mechanisms of conventional thermal printers are complex and unwieldy, increasing the size of a thermal printer having such a mechanism.

SUMMARY OF THE INVENTION

It is therefore an object of the present invention to provide an improved thermal printer having a reduced size, and capable of preventing a thermal line printhead from adhering to a platen roller.

In order to meet the objects of the invention, a thermal printer includes a rubber platen roller for feeding a recording sheet in the printer. A thermal line printhead opposes the platen roller and is biased toward the platen roller. The thermal line printhead contacts the platen roller when a recording sheet is absent from the printer, and presses the recording sheet against the platen roller when the recording sheet is fed in the printer. An adsorption preventing powder agent is coated on the surface of the rubber platen roller. In this manner, the rubber platen is prevented from adhering to the thermal line printhead by adsorptive adhesive action when left for an extended period of time.

Preferably, the adsorption preventing powder agent is a powder of 10 μm mean particle diameter or less. More preferably, the mean particle diameter of the adsorption preventing powder agent is 1 μm or less. Further preferably, the adsorption preventing powder agent is selected from the group consisting of talc, alumina, disulfide molybdenum, magnesium oxide, and ethylene tetraflouride.

A particularly favorable development of the invention is reached when the adsorption preventing powder agent is talc powder. In this case, the talc powder is of 0.2 μm mean particle diameter or less.

In one embodiment of the invention, the adsorption preventing powder agent is impregnated in the surface of the platen roller. Accordingly, the adsorption preventing powder agent remains on the surface of the platen roller longer than if the powder is simply coated on the surface of the roller.

Preferably, the adsorption preventing powder agent is impregnated in the surface of the platen roller by filling depressions in the surface of the platen roller with particles of the adsorption preventing powder agent at a temperature higher than a maximum operating temperature of the thermal printer. The platen roller is then cooled to a temperature lower than the maximum operating temperature to partially surround the particles of the adsorption preventing powder agent.

According to another favorable development of the invention, the platen roller is coated with silicone rubber.

According to another aspect of the invention, a platen roller for a thermal printer includes a rubber roller body. An adsorption preventing powder agent, selected from the group consisting of talc powder, alumina powder, disulfide molybdenum, magnesium oxide, and ethylene tetraflouride, is coated on the surface of the rubber roller body. The adsorption preventing powder agent selected from this group is particularly suitable for preventing the adhesion of the platen roller to a contacting surface over and extended period of time.

Preferably, the adsorption preventing powder agent is a powder of 10 μm mean particle diameter or less. More preferably, the mean particle diameter of the adsorption preventing powder agent is 1 μm or less. A particularly favorable development of the invention is reached when the adsorption preventing powder agent is talc powder. In this case, the talc powder is of 0.2 μm mean particle diameter or less.

In one embodiment of the invention, the adsorption preventing powder agent is impregnated in the surface of the roller body. Accordingly, the adsorption preventing powder agent remains on the surface of the roller body for longer than if the powder is simply coated on the surface of the roller body. Preferably, the adsorption preventing powder agent is impregnated in the surface of the roller body by filling depressions in the surface of the roller body with particles of the adsorption preventing powder agent at a temperature higher than a predetermined temperature, then cooling the platen roller at a temperature lower than the predetermined temperature to partially surround the particles of the adsorption preventing powder agent.

According to another advantageous feature of the invention, the rubber roller body is formed from silicone rubber.

According to still another aspect of the invention, a method of preparing a surface of a platen roller of a thermal printer for resisting adhesion to a thermal printhead of the printer includes heating the platen roller to a temperature higher than a maximum operating temperature of the thermal printer. Depressions in a surface of the platen roller are filled with particles of an adsorption preventing powder agent; cooling the platen roller at a temperature lower than the maximum operating temperature; and partially surrounding the particles of the adsorption preventing powder agent to impregnate the adsorption preventing powder agent in the surface of the platen roller.

DETAILED DESCRIPTION OF THE PREFERRED EMBODIMENTS

Figure 1:
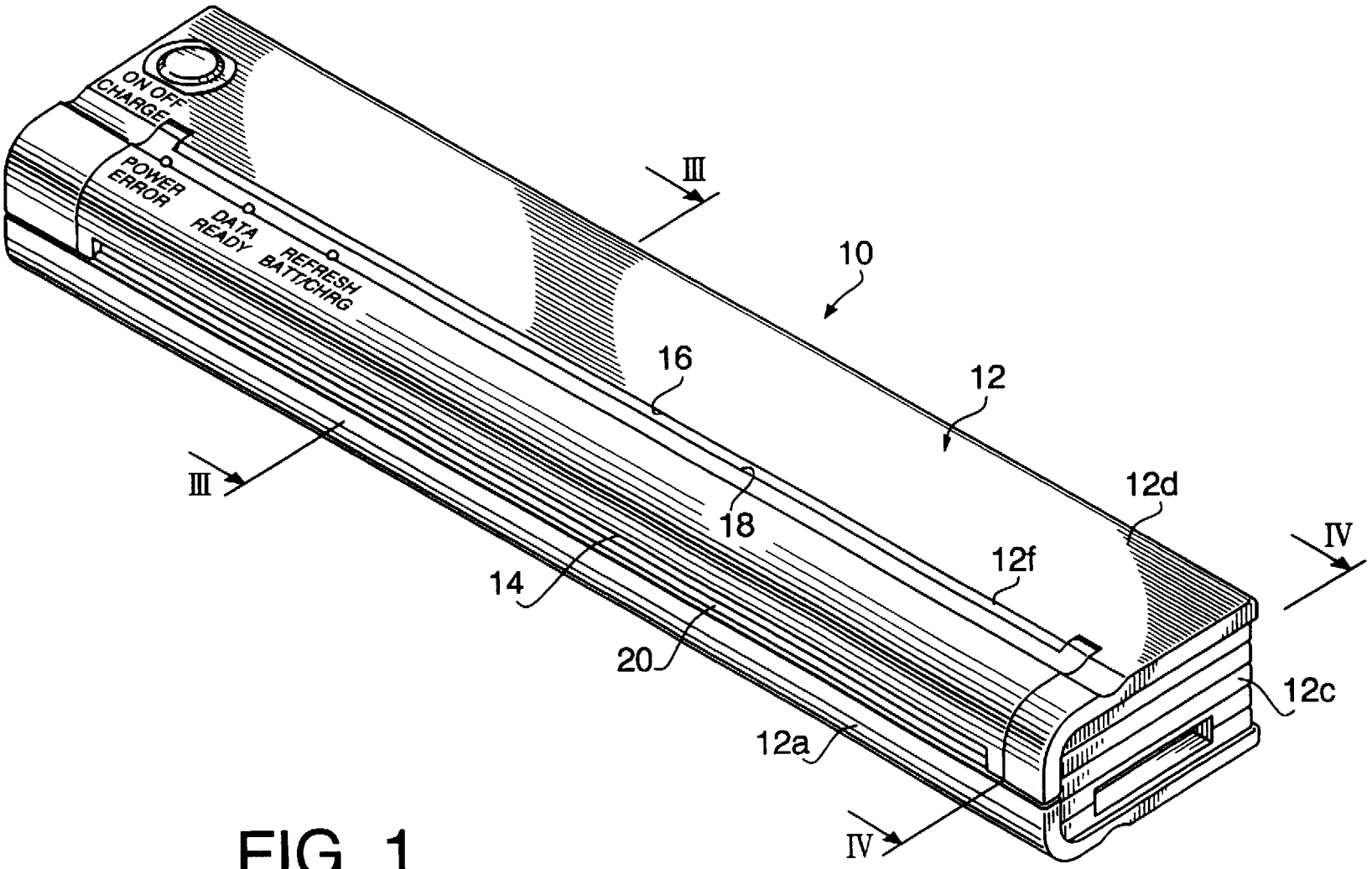
FIG. 1 shows a perspective view of an embodiment of a thermal printer according to the invention, with a cover closed.
Figure 2:
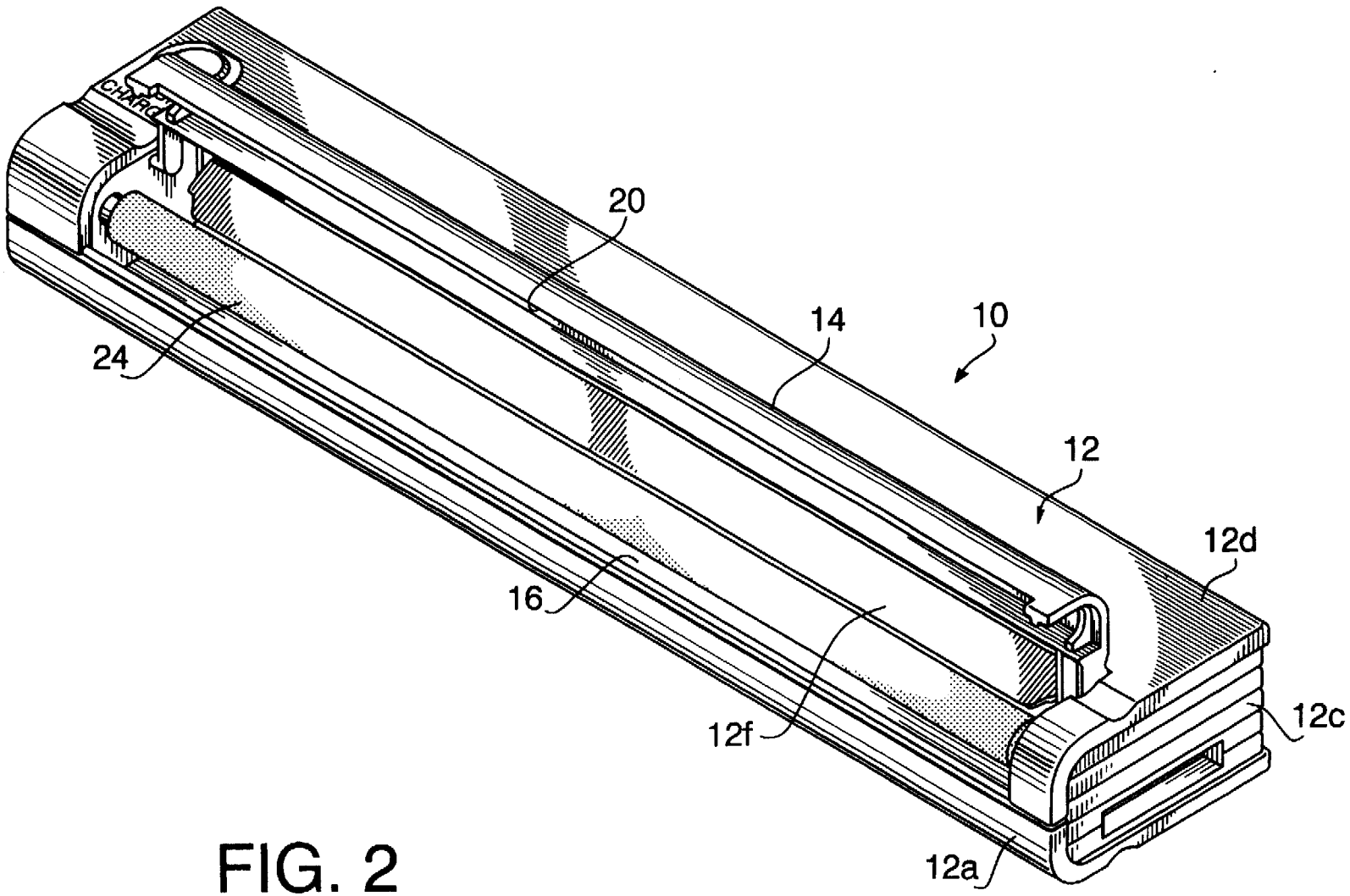
FIG. 2 shows a perspective view of the thermal printer of FIG. 1, with the cover open.

FIG. 1 is a perspective view of an embodiment of a thermal printer according to the present invention. A printer 10 as shown in FIGS. 1 and 2 is provided with a substantially rectangular outer housing 12. The housing 12 includes a lower housing 12*a*, side covers 12*c* attached to the left and right sides of the lower housing 12*a*, and an upper housing 12*d* attached to the top of the side covers 12*c*. Each cover is made entirely of synthetic resins. The housing 12 has a lengthwise opening 16 formed therein, at a corner between a top surface and a front surface of the upper housing 12*d*.

A cover 14 is swingably supported by pivot shafts 14*b* (shown in FIG. 4) within the opening 16 in the housing 12. FIG. 1 shows the cover 14 in a closed position, and FIG. 2 shows the cover 14 in an open position. An insertion slot 18, through which a recording sheet is inserted in the printer 10, is formed in the cover 14 between the housing and the top portion of the cover 14. The recording sheet may be thermal paper, peel-off paper, plain paper or OHP (overhead projection) film faced with a thermal inking sheet, i.e., any thermally responsive recording media. A discharge slot 20, for discharging a recording sheet from the printer 1, is formed in the cover 14 between the housing 12 and the lower portion of the cover 14.

Figure 3:
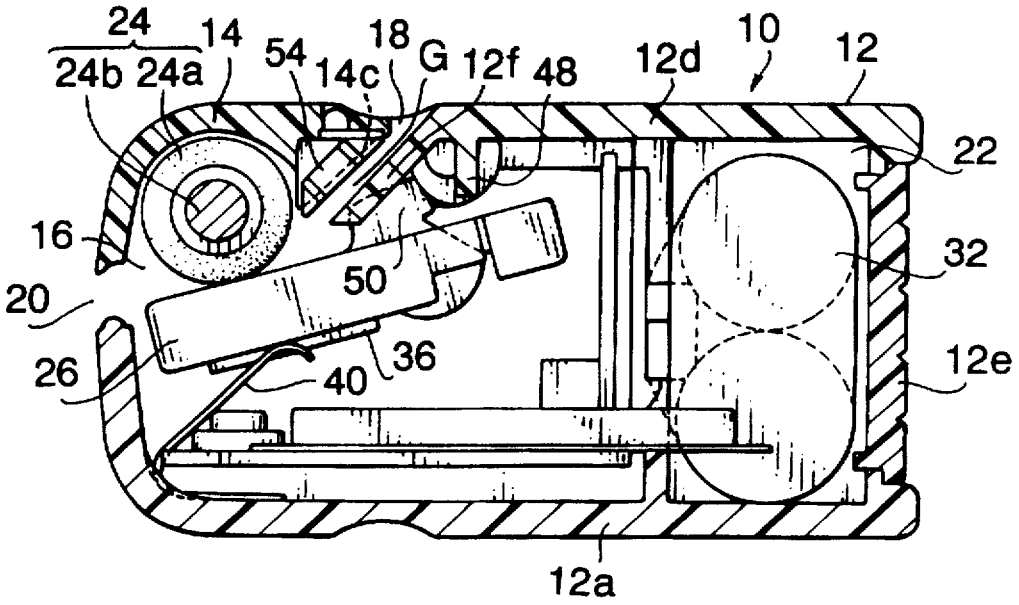
FIG. 3 shows a cross section taken along the III—III line of FIG. 1.

As shown in FIG. 3, a guide plate 12*f* extends at a downward angle from the upper housing 12*d* nearest the opening 16. A guide section 14*c*, integral with the cover 14, faces the guide plate 12*f* forming a guide path G therebetween. A battery compartment 22 is formed in the rear of the housing 12 for housing batteries 32. In this case, the batteries are nickel cadmium batteries. The open back surface of the battery compartment 22 is covered over by a battery compartment cover 12*e*.

A platen roller 24 against which an inserted recording sheet is pressed, and which rotates to feed an inserted recording sheet, is rotatably mounted in the housing 12. The platen roller 24 includes a rubber roller unit 24*a*, and a pivot shaft 24*b* fitted on each end of the roller unit 24*a*. The platen roller 24 is rotated by a drive mechanism (not shown) to feed an inserted recording sheet.

Figure 4:
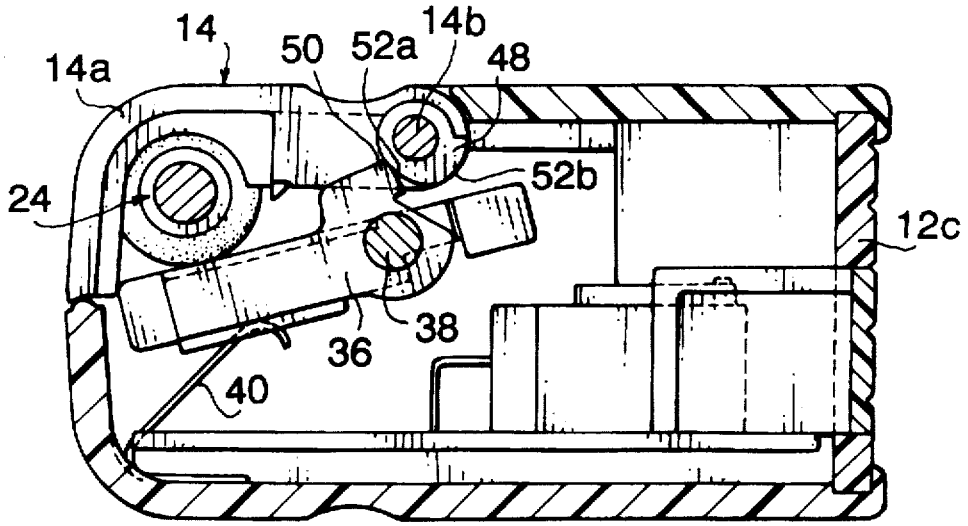
FIG. 4 shows a cross section taken along the IV—IV line of FIG. 1.

A thermal line printhead 26 is supported by a swingable frame 36 that is swingable toward and away from the platen roller 24, in association with movement of the covering member 14. As shown in FIG. 4, the swingable frame 36 is swingably supported by the housing 12 via an axle 38.

A plate spring 40, attached to the bottom surface of the lower housing 12*a*, keeps the thermal line printhead 26 biased against the platen roller 24. The thermal line printhead is not moved depending on the presence or absence of a recording sheet, but is pressed toward and against the platen roller regardless of whether there is a recording sheet in the feeding path or not.

As shown in FIG. 4, a jam release mechanism that pivots the thermal line printhead 26 includes a cam 48 on the pivot shaft 14*b* of the cover 14, and a follower 50 unitarily formed on the swingable frame 36, in contact with the cam 48. The follower 50 is pressed against the cam 48 by the plate spring 40.

A small cam sector 52*a* and a large cam sector 52*b* form the outer perimeter of the cam 48. When the cover 14 is closed, the follower 50 contacts the small cam sector 52*a*, and the thermal line printhead 26 is biased against the platen roller 24 with the force of the plate spring 40. When the cover 14 is opened, the large cam sector 52*b* swings around and pushes on the follower 50, swinging the thermal line printhead 26 away from the platen roller 24. A controller (not shown) for controlling printing by the thermal line printhead 26 and the driving mechanism is also provided in the housing 12. The controller is able to receive printing information from a data source connected to the printer 1.

In order to print, a recording sheet is inserted into the insertion slot 18 along the feeding path G. As printing information is received from the data source, the platen roller 24 is rotated, and the recording sheet is drawn between the platen roller 24 and the thermal line printhead 26. As the recording sheet is advanced past the thermal line printhead 26, images are formed on the recording sheet by the thermal line printhead 26. The recording sheet with the images imprinted thereon is ejected from the delivery slot 20 to the outside of the printer 1.

As the thermal line printhead 26 is in contact with the platen roller 24 at all times, except when the recording sheet jam mechanism is operated, no retraction mechanism is necessary, and the size of the printer 1 is smaller than a printer having a retraction mechanism. However, because the thermal line printhead 26 is not retracted when a recording sheet is absent, the thermal line printhead 26 is always resting against the platen roller 24. If a recording sheet is not present, the thermal line printhead 26 makes direct contact with the platen roller 24. Since the surface of the platen roller 24 is rubber, if the printhead 26 is left in contact with the roller 24 for extended periods of time, the platen roller 24 tends to adhere to the thermal line printhead 26 due to adsorptive adhesive action. Over an extended period of time, the thermal line printhead 26 may stick to the platen roller 24, and the platen roller 24 may resist driving upon the next printing operation.

In order to combat this possibility, the surface of the roller unit 24*a* is coated with an adsorption preventing agent, for example a powder, to prevent the thermal line printhead 26 from adhering to the roller 24. In this embodiment, a roller 24 made of silicone rubber has a surface coated, or impregnated, with a talc powder having particles of approximately 0.2 μm mean diameter or less as an adsorption preventing agent.

Figure 5:
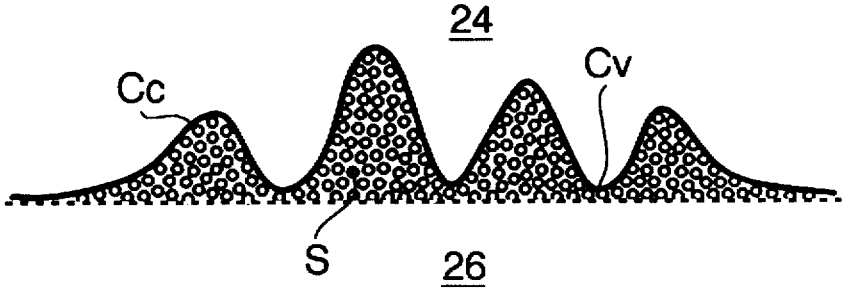
FIG. 5 shows a schematic view of the rubber surface of the platen roller.

As shown in FIG. 5, the rubber has surface irregularities invisible to the naked eye. The adsorption preventing agent (powder) S enters only the depressions Cc of the surface of the roller 24. The adsorptive adhesiveness of the rubber of the platen roller 24 is thereby reduced by coating the surface thereof with the adsorption preventing powder agent. However, the feeding force on the recording sheet is dependent on the frictional resistance of peaks Cv in the surface of the roller 24. Accordingly, there is little variation in the feeding force before and after coating with the adsorption preventing agent (powder). Even if the printer is not used for extended periods of time, with the thermal line printhead 26 pressing against the platen roller 24, the printhead 26 is prevented from adhering to the roller surface 24.

Alternatively, alumina powder, disulfide molybdenum, magnesium oxide, ethylene tetrafluoride, or another fine powder agent, preferably having a particle size of 10 μm mean diameter or less, is used instead of talc powder. More preferably, the mean particle diameter of the adsorption preventing powder agent is 1 μm or less.

Figure 6A:
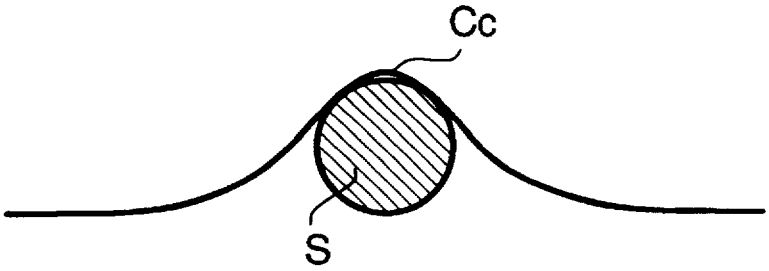
FIG. 6A shows the state of the adsorption preventing powder agent coated on the platen roller at high temperature.
Figure 6B:
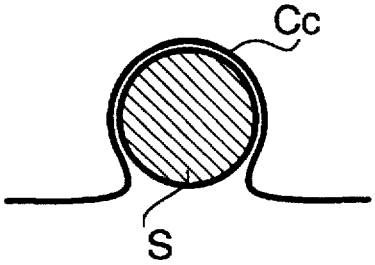
FIG. 6B shows the state of the adsorption preventing powder agent coated on the platen roller once returned to normal operating temperature.

Advantageously, the adsorption preventing powder is applied when the roller unit 24a is heated to a temperature greater than the maximum operating temperature of the printer. As shown in FIG. 6A, when the roller 24 is heated, the depressions Cc expand. In the process of returning to room or operating temperatures, the rubber and the depressions Cc contract. By applying the adsorption preventing powder agent while the depressions Cc are expanded, the adsorption preventing powder agent S is caught and held in the depressions Cc as they contract at room temperature. Accordingly, the adsorption preventing powder agent can remain looked into and on the surface of the rubber longer than if applied at normal temperatures, preserving the adsorption preventing effect over an extended period of time.

As explained above, by eliminating a need for a retraction mechanism, a printer of overall compact size can be constructed. Further, by coating the platen roller with an adsorption preventing powder agent, the adhesiveness of the rubber surface of the platen roller can be reduced, preventing adhesion of the thermal printhead to the platen roller in a thermal printer using a thermal line printhead is prevented. Further, by impregnating the adsorption preventing powder agent in the surface of the platen roller, the resistance to adsorptive adhesive action can be extended for a long period of time.

The present disclosure relates to subject matter contained in Japanese Patent Application No. HEI 07-81739, filed on Mar. 14, 1995, which is expressly incorporated herein by reference in its entirety.

What is claimed is:

1. A thermal printer, comprising:

a platen roller for feeding a recording sheet in the printer;

said platen roller being made of a rubber which upon cooling from a heated state, where it is heated above its normal operating temperature, will tend to enclose and partially surround particles which are placed on the surface of the roller when it is in such a heated state a thermal line printhead opposing said platen roller and biased toward said platen roller, said thermal line printhead contacting said platen roller when a recording sheet is absent from said printer, and pressing the recording sheet against said platen roller when the recording sheet is fed in said printer; and an adsorption preventing powder agent having particles impregnated in depressions in the surface of said rubber platen roller by coating said particles on said platen roller while it is heated above its normal operating temperature and permitting said platen roller to cool.

2. The thermal printer according to claim 1, wherein said adsorption preventing powder agent is a powder of particles having a mean particle diameter of 10 μm or less.

3. The thermal printer according to claim 2, wherein said adsorption preventing powder agent is selected from the group consisting of talc, alumina, disulfide molybdenum, magnesium oxide, and ethylene tetraflouride.

4. The thermal printer according to claim 3, wherein said adsorption preventing powder agent is talc powder.

5. The thermal printer according to claim 4, wherein said talc powder is a powder of particles having a mean particle diameter of 0.2 μm or less.

6. The thermal printer according to claim 2, wherein said adsorption preventing powder agent is a powder of particles having a mean particle diameter of 1 μm or less.

7. The thermal printer according to claim 1, wherein said platen roller is silicone rubber.

8. A platen roller for a thermal printer, comprising:

a roller body;

said roller body being made of rubber which upon cooling from a heated state, where it is heated above its normal operating temperature, will tend to enclose and partially surround particles which are placed on the surface of the roller when it is in such a heated state an adsorption preventing powder agent having particles selected from the group consisting of talc, alumina, disulfide molybdenum, magnesium oxide, and ethylene tetraflouride, said particles being impregnated in depressions in the surface of said rubber roller body by coating said particles on said roller body while it is heated above its normal operating temperature and permitting said roller body to cool.

9. A platen roller for a thermal printer according to claim 8, wherein said adsorption preventing powder agent is a powder of particles having a mean particle diameter of 10 μm or less.

10. A platen roller for a thermal printer according to claim 9, wherein said adsorption preventing powder agent is a powder of particles having a mean particle diameter of 1 μm or less.

11. A platen roller for a thermal printer according to claim 8, wherein said adsorption preventing powder agent is talc.

12. A platen roller for a thermal printer according to claim 11, wherein said talc is a powder of particles having a mean particle diameter of 0.2 μm or less.

13. The thermal printer according to claim 8, wherein said rubber roller body is silicone rubber.

14. A method of preparing a surface of a platen roller of a thermal printer for resisting adhesion to a thermal printhead of the printer, comprising:

heating the platen roller to a temperature higher than a maximum operating temperature of the thermal printer;

filling depressions in a surface of the platen roller with particles of an adsorption preventing powder agent;

cooling said platen roller at a temperature lower than said maximum operating temperature; and partially surrounding said particles of said adsorption preventing powder agent with platen roller material to impregnate said adsorption preventing powder agent in the surface of said platen roller.

15. A thermal printer, comprising:

a platen roller for feeding a recording sheet in the printer;

said platen roller being made of rubber which upon cooling from a heated state, where it is heated above its normal operating temperature, will tend to enclose and partially surround particles which are placed on the surface of the roller when it is in such a heated state a thermal line printhead opposing said platen roller and biased toward said platen roller, said thermal line printhead contacting said platen roller when a recording sheet is absent from said printer, and pressing the recording sheet against said platen roller when the recording sheet is fed in said printer; and an adsorption preventing powder agent impregnated in depressions in the surface of said platen roller by coating said particles on said platen roller while it is heated above its normal operating temperature and permitting said roller body to cool, thereby reducing an adsorptive adhesiveness of said platen roller without lowering a feeding force for feeding said recording sheet.

16. The thermal printer according to claim 15, wherein said adsorption preventing powder agent is a powder of particles having a mean particle diameter of 10 μm or less.

17. The thermal printer according to claim 16, wherein said adsorption preventing powder agent is selected from the group consisting of talc, alumina, disulfide molybdenum, magnesium oxide, and ethylene tetraflouride.

18. The thermal printer according to claim 17, wherein said adsorption preventing powder agent is talc powder.

19. The thermal printer according to claim 18, wherein said talc powder is a powder of particles having a mean particle diameter of 0.2 μm or less.

20. The thermal printer according to claim 16, wherein said adsorption preventing powder agent is a powder of particles having a mean particle diameter of 1 μm or less.

21. The thermal printer according to claim 15, wherein said platen roller is silicone rubber.

22. A platen roller for a thermal printer, comprising:

a roller body;

said roller body being made of a rubber which upon cooling from a heated state, where it is heated above its normal operating temperature, will tend to enclose and partially surround particles of an adsorption preventing powder which are placed on the surface of the roller when it is in such a heated state said adsorption preventing powder agent selected from the group consisting of talc, alumina, disulfide molybdenum, magnesium oxide, and ethylene tetraflouride, said particles being impregnated in depressions in said roller body by coating said particles on said roller body while it is heated above its normal operating temperature and permitting said platen roller to cool, thereby reducing an adsorptive adhesiveness of said platen roller without lowering a feeding force for feeding said recording sheet.

23. A platen roller for a thermal printer according to claim 22, wherein said adsorption preventing powder agent is a powder of particles having a mean particle diameter of 10 μm or less.

24. A platen roller for a thermal printer according to claim 23, wherein said adsorption preventing powder agent is a powder of particles having a mean particle diameter of 1 μm or less.

25. A platen roller for a thermal printer according to claim 22, wherein said adsorption preventing powder agent is talc powder.

26. A platen roller for a thermal printer according to claim 25, wherein said talc is a powder of particles having a mean particle diameter of 0.2 μm or less.

27. A platen roller for a thermal printer according to claim 22, wherein said roller body is silicone rubber.

* * * * *